US011377804B2

(12) United States Patent
Arndt

(10) Patent No.: US 11,377,804 B2
(45) Date of Patent: Jul. 5, 2022

(54) HIGHWAY SOUND BARRIER SYSTEM

(71) Applicant: Phoenix Foam Manufacturing, LLC, Grand Rapids, MI (US)

(72) Inventor: Michael E. Arndt, Grand Rapids, MI (US)

(73) Assignee: Phoenix Foam Manufacturing, LLC, Grand Rapids, MI (US)

( * ) Notice: Subject to any disclaimer, the term of this patent is extended or adjusted under 35 U.S.C. 154(b) by 0 days.

(21) Appl. No.: 17/405,949

(22) Filed: Aug. 18, 2021

(65) Prior Publication Data

US 2021/0372061 A1 Dec. 2, 2021

Related U.S. Application Data

(63) Continuation-in-part of application No. 17/026,635, filed on Sep. 21, 2020, now abandoned.

(60) Provisional application No. 62/928,672, filed on Oct. 31, 2019.

(51) Int. Cl.
*E01F 8/00* (2006.01)

(52) U.S. Cl.
CPC ..... *E01F 8/0017* (2013.01); *E01F 8/0023* (2013.01)

(58) Field of Classification Search
CPC ... E04H 17/16; E04H 17/1602; E04H 17/165; E04H 17/168; E04H 17/20; E04H 17/22; E04H 17/166; E01F 8/0011; E01F 8/0017; E01F 8/0023; E01F 15/08; E01F 15/081; E01F 15/086; E01F 8/0029
USPC ..... 256/24, 26, 31
See application file for complete search history.

(56) References Cited

U.S. PATENT DOCUMENTS 4,111,401 A * 9/1978 Pickett ..... E01F 8/0017 256/13.1
4,529,174 A * 7/1985 Pickett ..... E01F 8/0017 256/25
4,605,090 A * 8/1986 Melfi ..... E01F 8/0017 181/210
4,887,691 A * 12/1989 Rotondo ..... E02D 27/42 181/210
4,899,498 A * 2/1990 Grieb ..... E01F 8/0017 52/144
5,134,815 A * 8/1992 Pickett ..... E01F 8/0023 405/285
7,708,492 B2 * 5/2010 Carey ..... E01F 15/025 404/6

(Continued)

FOREIGN PATENT DOCUMENTS

CN 109183684 A * 1/2019 ..... E01F 15/08
KR 20110128622 A * 11/2011 ..... E01F 8/0023

(Continued)

*Primary Examiner* — Matthew R McMahon
(74) *Attorney, Agent, or Firm* — Frank M. Scutch, III

(57) ABSTRACT

A highway sound barrier system that uses a plurality of foam panels that are joined with an upright member assembly. The foam panels use a foam core and exterior weather protection compounds allowing the system to dramatically reduce transportation, handling and installation costs while increasing the lifecycle of the barrier system and reducing long term maintenance requirements. Moreover, the foam panels include rotatable joints and cable reinforcement allowing the wall to be easily adjusted to facilitate various landscape parameters and provide for rapid construction.

16 Claims, 14 Drawing Sheets

(56) References Cited

U.S. PATENT DOCUMENTS

2008/0315169 A1* 12/2008 McNeill ..... E01F 9/692
256/1

FOREIGN PATENT DOCUMENTS

KR 20140025074 A * 3/2014 ..... E01F 8/0023
KR 20160013233 A * 2/2016 ..... E01F 8/0088

* cited by examiner

HIGHWAY SOUND BARRIER SYSTEM

FIELD OF THE INVENTION

This invention relates to noise abatement systems and more particularly to highway noise barriers used to reduce noise from vehicle traffic.

BACKGROUND

Throughout the world, highway systems are commonly used by the population for commercial and personal transportation. In North America, and indeed throughout the world, these highway noise barriers are utilized to reduce unwanted truck and automobile noise from reaching residential areas.

Current wall designs used for noise abatement have not evolved much in the last 70 years. Typically, these high noise barriers are made of concrete or concrete mixtures but are also sometimes made of steel, wood or other masonry products. The problem in using these materials is that they are expensive, often hard to use, time consuming to install and not entirely effective in reducing noise in a highway environment. Moreover, the manufacturing of the materials has a negative impact on the environment. Accordingly, revolutionary and more sustainable solutions are needed to address current issues with highway barriers used to provide noise abatement.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention

FIG. 5A and FIG. 5B are magnified views of the spline connections shown in FIG. 5.

DETAILED DESCRIPTION OF THE PREFERRED EMBODIMENT

Figure 1:
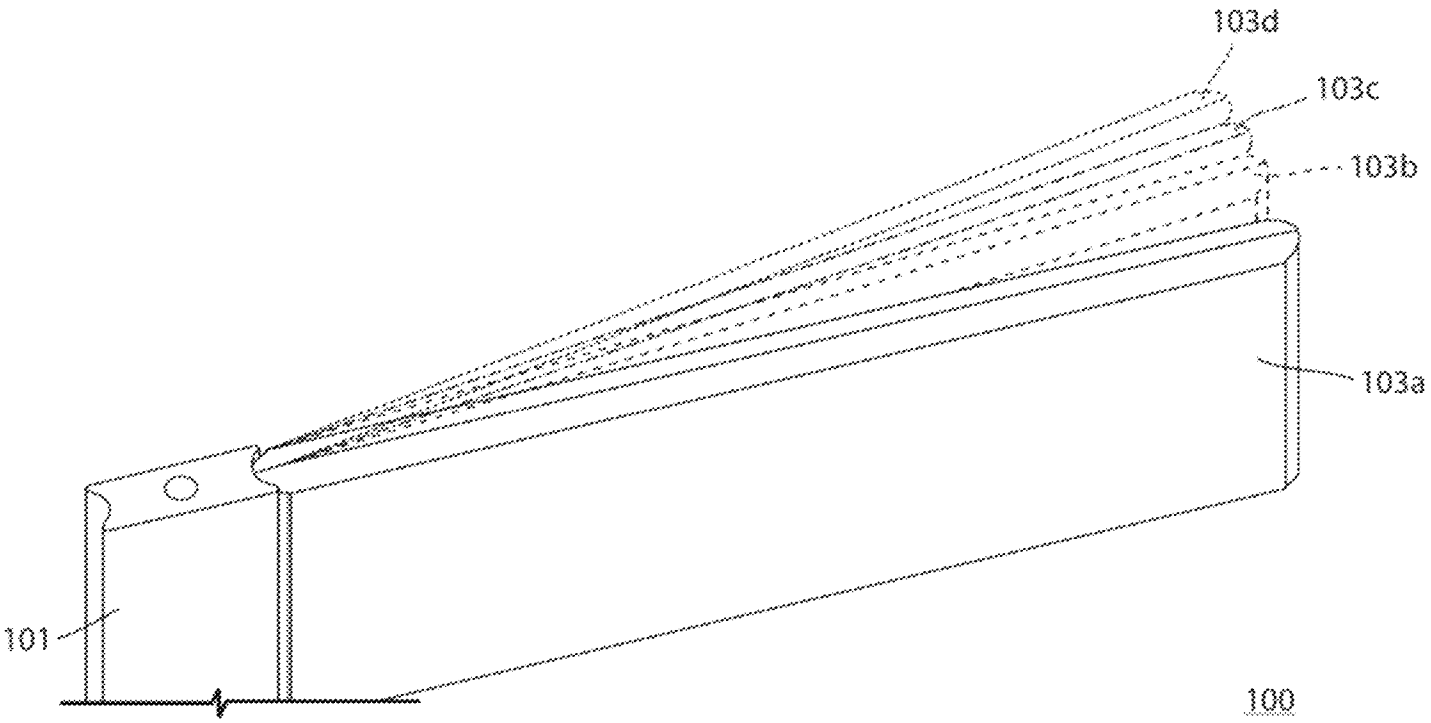
FIG. 1 illustrates a foam wall assembly used in the highway sound barrier system showing multiple possible rotations according to an embodiment of the invention.

Before describing in detail embodiments that are in accordance with the present invention, it should be observed that the embodiments reside primarily in combinations of method steps and apparatus components related to a highway sound barrier system. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element FIG. 1 illustrates a highway sound barrier system 100 consisting of an upright member 101 where one cross-member 103*a*, 103*b*, 103*c*, 103*d* is shown in various angled orientations. More specifically, the cross-member is shown in a 0-degree, 5-degree, 7.5-degree, and 10-degree rotated position respectively. Those skilled in the art will recognize that any degree rotation of the cross-member from 0-degree to +/−10-degree is possible allowing for an infinite number of angular rotations allowing the system to conform to design requirements.

Figure 2A:
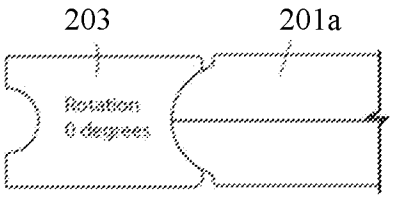
FIG. 2A illustrates an example of a "fan assembly" at a 0-degree rotation showing the angular capabilities of the invention
Figure 2B:
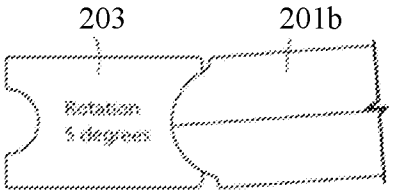
FIG. 2B illustrates an example of a "fan assembly" at a 5-degree rotation showing the angular capabilities of the invention
Figure 2C:
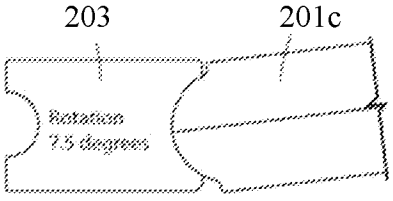
FIG. 2C illustrates an example of a "fan assembly" at a 7.5-degree rotation showing another angular capability of the invention
Figure 2D:
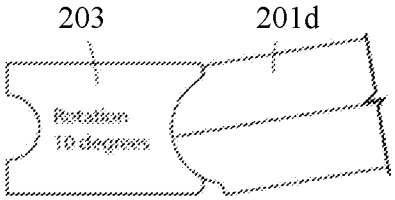
FIG. 2D illustrates an example of a "fan assembly" at a 10-degree rotation showing another angular capability of the invention

FIG. 2A, FIG. 2B, FIG. 2C, and FIG. 2D are top views illustrating various examples of the barrier system set at in a range 0 to 10-degree rotation showing the angular capabilities of the invention. FIG. 2A shows cross member 201*a* set at 0-degrees in relation to upright member 203. FIG. 2B shows cross-member 201*b* set at 5-degrees in relation to upright member 203. FIG. 2C shows cross-member 201C set at 7.5-degrees in relation to the upright member 203. Finally, FIG. 2D shows cross member 201*d* set at 10-degrees in relation to the upright member 203.

Figure 3:
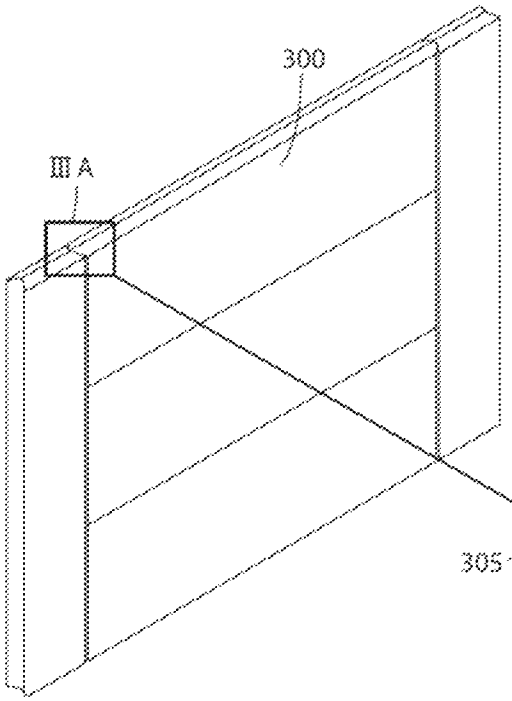
FIG. 3, FIG. 3A and FIG. 3B illustrate a 3-tier wall assembly and a single foam panel with the coating shown in the transparent view shown in FIG. 3B.
Figure 3A:
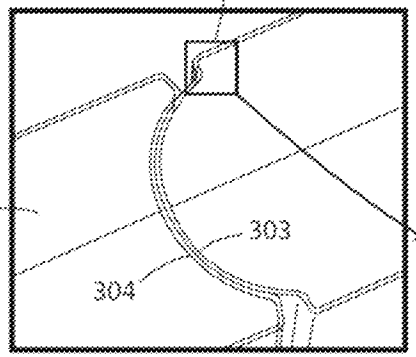
Figure 3B:
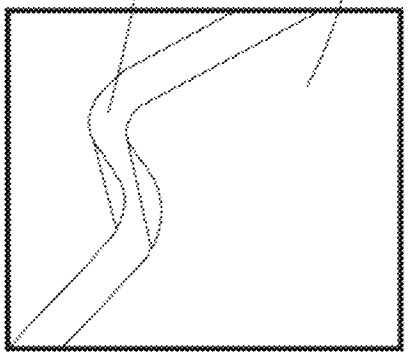

FIG. 3, FIG. 3A and FIG. 3B illustrate a 3-tier wall assembly having a single foam panel with the coating shown in a transparent view as seen in FIG. 3. FIG. 3A illustrates a magnified view of area IIIA shown in FIG. 3. FIG. 3B shows a magnified view shown as area IIIB shown in FIG. 3A. As seen in both FIG. 3 and FIG. 3A, the unique shape allows the cross-members to nest into each other forming a strong bond. The required overall length of each cross-member is determined by particular design requirements with typical lengths ranging from 1 to 12 feet or more. More specifically, the horizontal cross-member panel 300 includes an inner core 301 and outer core 302 having a tongue end 303 that inserts into a groove end 304 on the upright member 305. The tongue end 303 has a convex surface forming a radius that is typically centered on the core while the groove end 304 is the reverse having a matching concave surface sized to fit with one another. The use of tongue and groove type arrangement allows the cross-member panel 300 to be used as an adjustable wall assembly.

As described herein, the interior core 301 is comprised of expanded or extruded polystyrene foam with the required density as per design criteria. The outer core 302 typically is spec'd as needed to coat the foam inner core 301 and provides additional sound attenuation and durability. The outer core 302 is typically comprised of a strong and durable single or multi-part polyurea type compound with a thickness as required by design. This compound minimizes damage and deterioration under exposure to moisture, ultraviolet radiation, ozone, and other harsh environmental conditions.

Those skilled in the art will further recognize that each cross-member may be set with or without a sealant or adhesive between them as required by design and or Federal and State building codes. Since the attachment point on the horizontal mating surfaces between each cross-member consists of a "tongue and groove" type feature, this prevents lateral movement and hinders sound transmission between them. Although shown as a sloped surface, the tongue and groove design may be a radiused, square, rectangle, pyramid, shaped or doweled as determined by design.

Figure 4A:
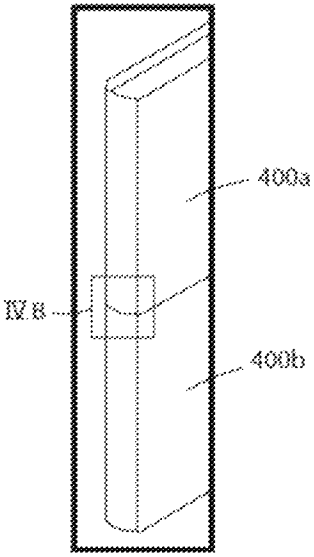
FIGS. 4A, 4B, 4C, and 4D are end views of the panel shown in FIG. 3 illustrating possible types of panel connections.
Figure 4B:
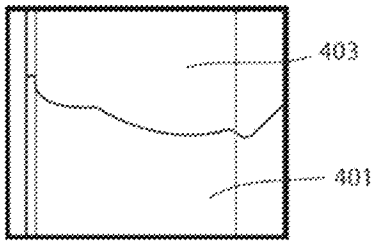
Figure 4C:
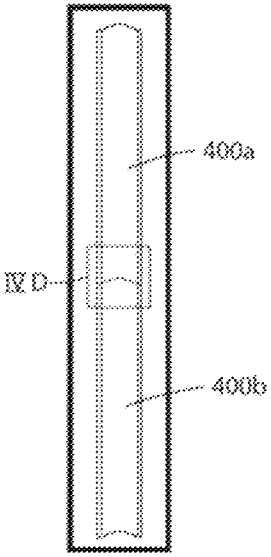
Figure 4D:
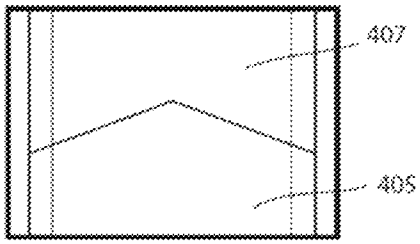

FIG. 4A illustrates a perspective view of the stacked foam cross member panels 400*a*/400*b* as used in embodiments of the invention. FIG. 4B is a magnified perspective view of a male spine 401 mated with a female spine 403 used to stack foam panels. FIG. 4C is an end view of the foam panel. FIG. 4D is a magnified end view showing the male 405 and female spline 407 as used in the foam panel. As noted herein, the end shape of the cross-member 400 is designed with a radius, allowing a plus/minus i.e., +/−10-degree rotation of various cross-member assemblies to accommodate design needs in the field.

Figure 5A:
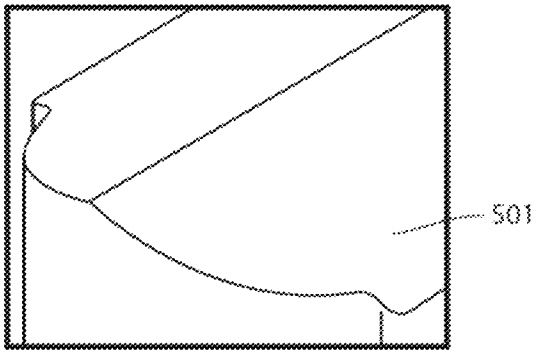
FIG. 5, FIG. 5A and FIG. 5B illustrate elevated views showing possible male and female spine connections used in a foam assembly.
Figure 5B:
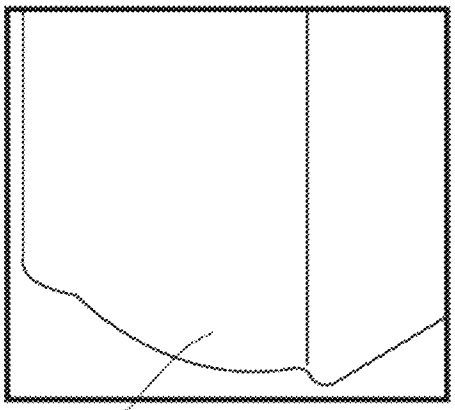
Figure 5:
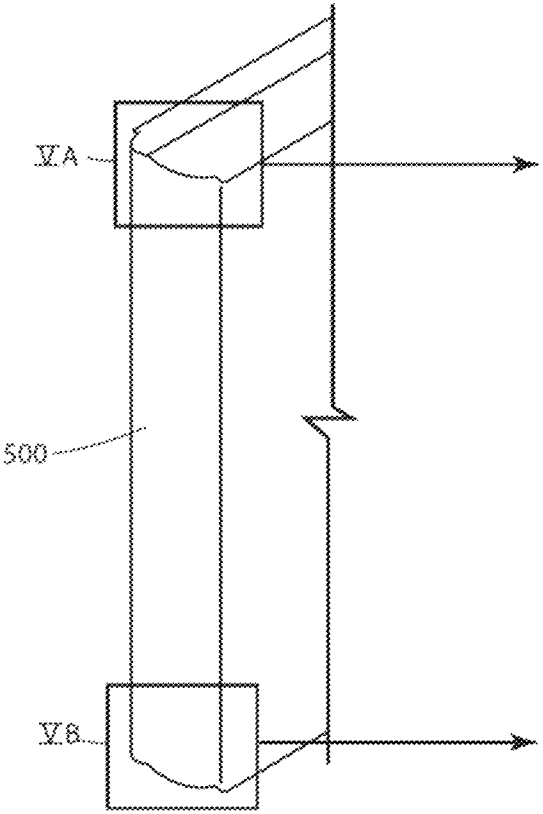

FIG. 5, FIG. 5A and FIG. 5B illustrate elevated views showing male and female spine connections used in a foam panel 500. More specifically, FIG. 5A and FIG. 5B are magnified views of the top and bottom sections respectively shown in FIG. 5. FIG. 5A shows the contour of the top section 501. FIG. 5B shows the contour of the bottom section 502.

Figure 6:
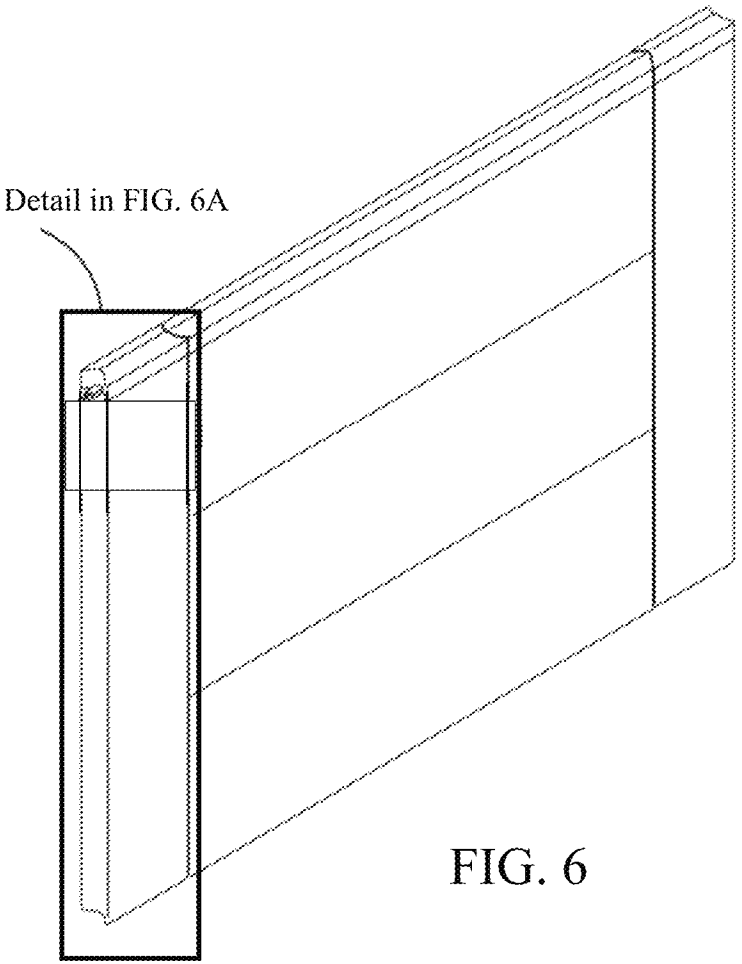
FIG. 6, FIG. 6A, illustrate details of an upright member assembly as used in the invention.
Figure 6A:
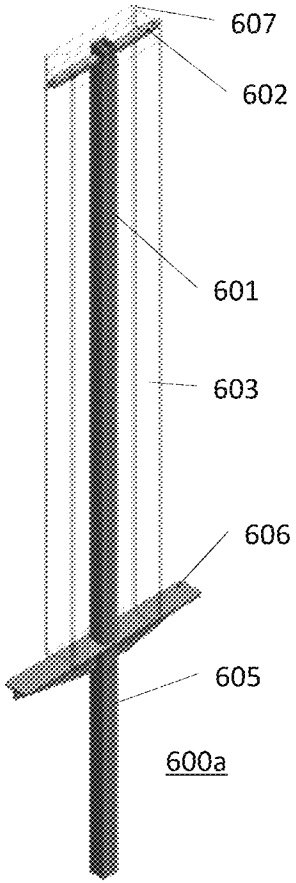

FIG. 6 illustrates a transparent view showing a upright member assembly used with various embodiments of the invention. FIG. 6A illustrates an upright member assembly 600*a* where the upright support 601 extends through the upright member 603. The upright member 603 uses an in-ground support member 605 having a base plate 606 for providing additional support under the cross members. The tension reinforcement anchor assembly 602 is shown sleaved into the upright support 601. A top cap 607 is fitted at the top of the upright member 603.

Thus, in FIG. 6A, the upright support 601 extends through a hole in the upright member 603 into the center of a self-supporting ledge 606. The upright member 603, can be formed of a post or pole of any shape, and can be hollow or solid such that the diameter and shape is determined by the design. Those skilled in the art will recognize that the upright member 603 has a post and/or panel-type form factor where its interior core uses expanded or extruded polystyrene foam. The upright member 603 may consist of one solid piece or multiple pieces of foam that are bonded together to form a post. At the core of the upright member assembly 600, a hole is used having a round or square shape as required, to allow an upright support 601 in the form of a structural pole to be inserted to full or partial height as required. As noted herein, the upright member 601 such as a pole can be connected to a second pole and/or footing that is cemented into the ground.

The overall height is also determined during design and will depend on wall height. In other embodiments, the upright member 601 may consist of multiple stacked poles or can be one contiguous section. In use, these poles can be assembled on top of the bottom-most pole that is cemented into the ground. An optional support ledge can be used if desired in order to support the weight of the cross-members without the need for special footings or foundations. The support ledge can be made from ferrous, non-ferrous, or molded plastic materials as required.

Figure 7:
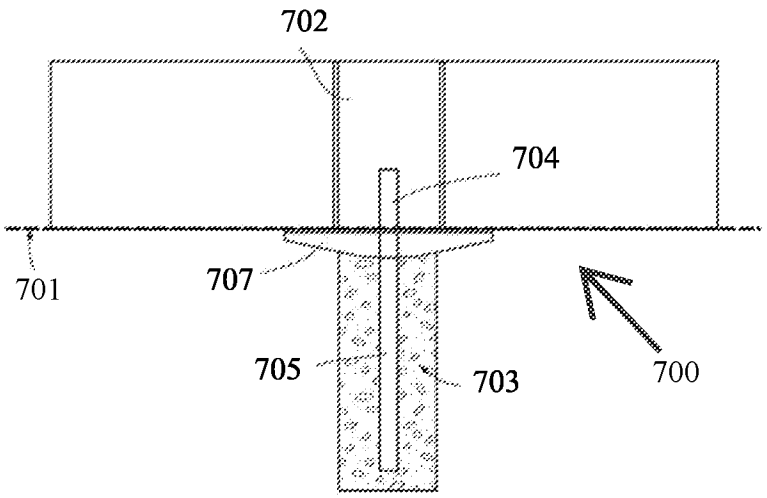
FIG. 7, FIG. 7A and FIG. 7B illustrate details of a support bracket that may be used in lieu of footings under the cross-members.
Figure 7B:
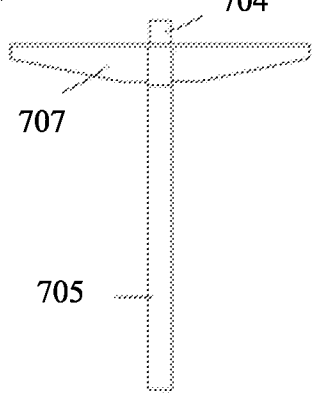
Figure 7A:
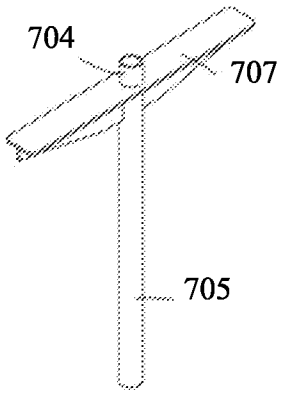

FIG. 7, FIG. 7A and FIG. 7B illustrate a support bracket assembly 700 that is located below ground level 701 and is typically positioned within a round bored concrete pier footing 703. An upright member assembly 700 includes a support pole or pipe 705 holding the assembly securely below ground level. An above ground upright support 704 is used to extend into the upright member 702. The below ground pipe 705 is attached to and extends a self-supporting ledge 707. The self-supporting ledge 707 may be used in lieu of any footings under the horizontal member 708.

Figure 8B:
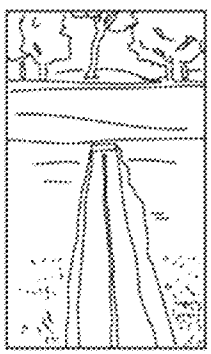
FIG. 8A, FIG. 8B and FIG. 8C illustrate alternative embodiment of the invention showing various footing designs that may be used under the cross-members and the support bracket shown in FIG. 7.
Figure 8A:
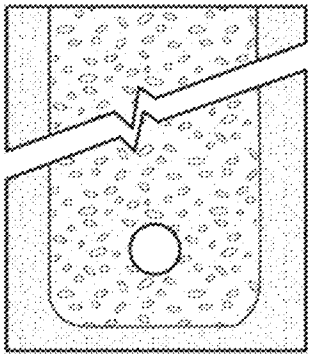
Figure 8C:
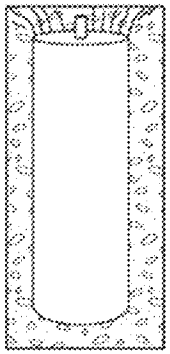

FIG. 8A, FIG. 8B and FIG. 8C illustrate various footing designs that may be used under the cross-members and the support bracket shown in FIG. 7. FIG. 8A is a sectional view illustrating a pea rock trench foundation. FIG. 8B is an elevated view illustrating a poured concrete trench foundation. Finally, FIG. 8C is an elevated view illustrating a poured concrete pier foundation which is a preferred embodiment of the invention. By nature of these designs, the cross-members, like that shown in FIG. 7, may be sitting on top of a self-supporting ledge 707 and require no special footing and/or foundation requirements. Those skilled in the art will recognize that there are multiple options for foundations if design requirements dictate that they are needed.

Figure 9:
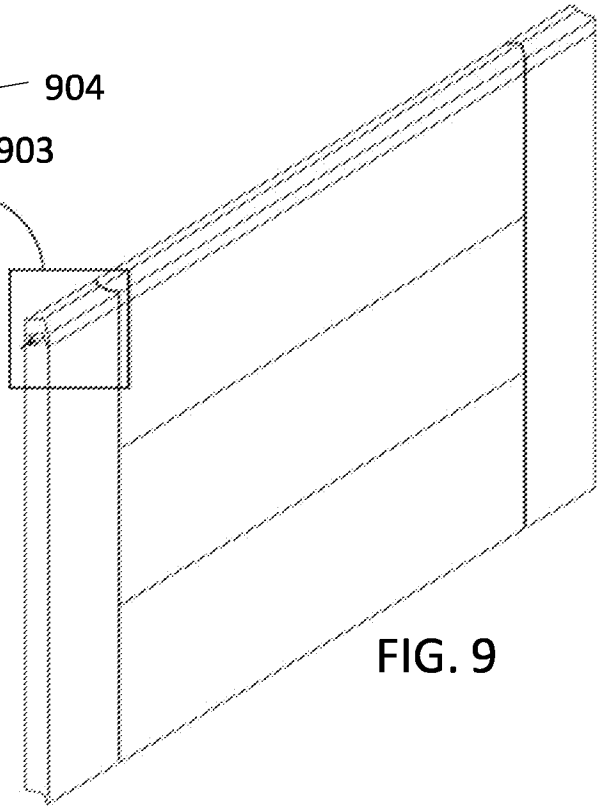
FIG. 9, FIG. 9A and FIG. 9B illustrate details of the tension reinforcement anchor assembly according to various embodiments of the invention.
Figure 9A:
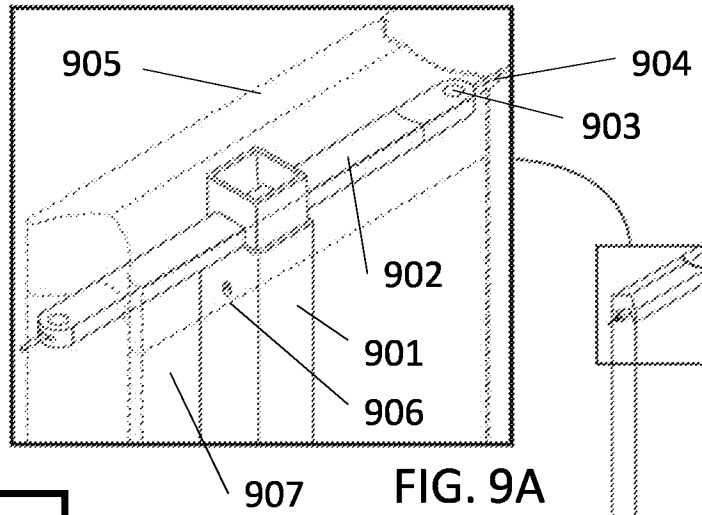
Figure 9B:
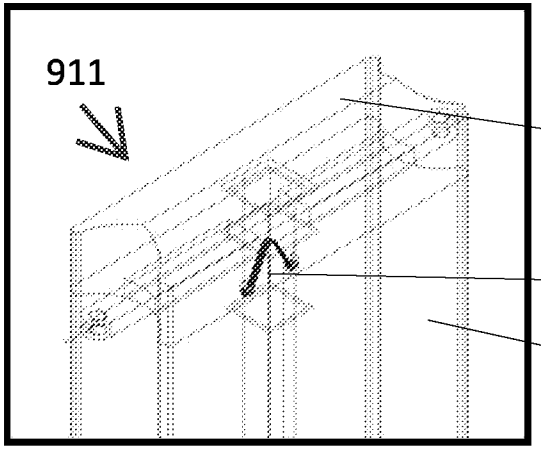

FIG. 9 illustrates a tension reinforcement anchor assembly as used in the invention. FIG. 9A and FIG. 9B illustrate magnified views of the tension reinforcement anchor assembly sleaved into the top of an upright support member. More specifically, FIG. 9A illustrates a tension reinforcement anchor bar 902 sleaved into the top an upright support member 901. The anchor bar 902 typically extends substantially orthogonally from the support member 901. A top cap 905 and upright assembly member 907 are illustrated transparently for ease in viewing. The anchor bar inserted sleeve 903 provides a convenient connector point for attaching a cable 904 on each end of the anchor bar 902. The cable 904 is attached within an aperture configured within the end of the anchor bar 902 that continues to allow for the +/− 10-degree rotation between the support bracket and the wall assembly.

In use, the anchor bar 902 is used to form a tension reinforcement anchor assembly. The tension reinforcement anchor assembly includes a spring-loaded pin that is engaged with a slotted pin hole 906 in the upright support member 901. When installed, the spring-loaded pin prohibits the tension reinforcement anchor assembly from sliding out of the upright support member. When under tension, the cable 904 enhances stability of the wall assembly and prevents excessive horizontal or vertical movement of the wall assembly. This makes for a far more rigid wall installation while still allowing for the +/− 10-degree rotation between the support bracket and the wall assembly. Further, FIG. 9B illustrates a detailed view of the self-locking pin assembly 908. The self-locking pin assembly 908 secures the tension reinforcement anchor assembly 911 to the upright support member. In this view, the top cap 910, upright assembly member 909 and the tension reinforcement anchor assembly are shown transparently. The opposing spring-loaded pin assembly will self-engage for securing the tension reinforcement anchor assembly into the upright support member 909 but still allow for quick and easy removal of the tension reinforcement anchor assembly if required.

Figure 10A:
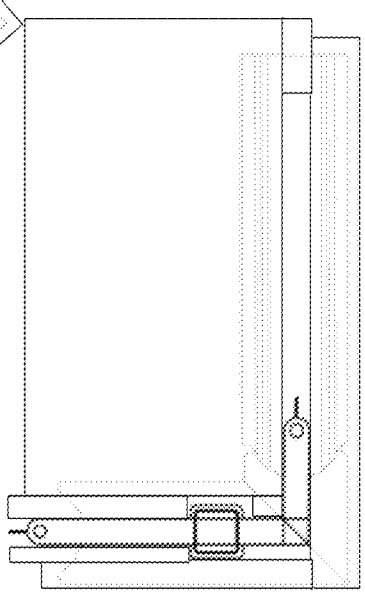
FIG. 10A, FIG. 10B and FIG. 10C illustrate the tension reinforcement anchor assembly with various large angle configurations.
Figure 10B:
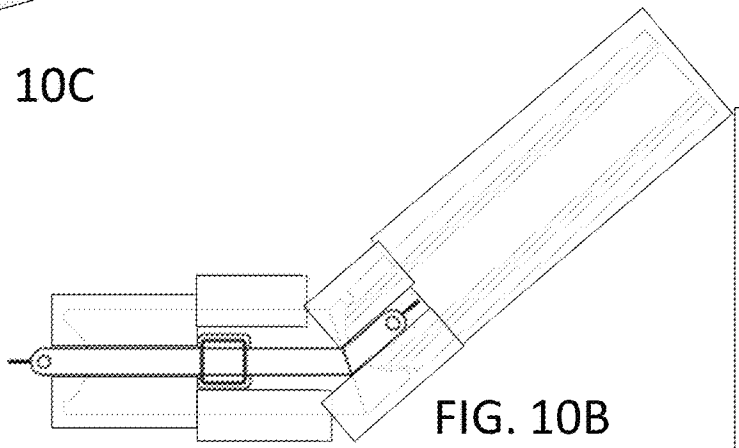
Figure 10C:
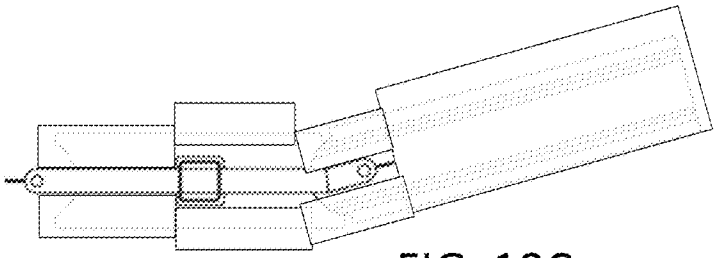

FIG. 10A, FIG. 10B and FIG. 10C illustrate views of the tension reinforcement anchor assembly with various large angle configurations. In these illustrations, the tension reinforcement anchor assembly is inlayed into various large angle upright and adjacent horizontal cross section assemblies with the top caps removed. More specifically, FIG. 10C illustrates a tension reinforcement anchor assembly inlayed into an upright and adjacent horizontal cross section assemblies with a 15-degree horizontal angle between them without the top cap. FIG. 16B illustrates a tension reinforcement anchor assembly inlayed into an upright and adjacent horizontal cross section assemblies with a 45-degree horizontal angle between them without the top cap. FIG. 10A illustrates a tension reinforcement anchor assembly inlayed into an upright and adjacent horizontal cross section assemblies with a 90-degree horizontal angle between them without the top cap. These illustrations are provided as examples of alternative angles and should not be considered exclusive to other angles or configurations. Additionally, the tension reinforcement anchor assembly can be constructed with a vertical angle to accommodate a change in elevation between consecutive upright assemblies. Regardless of the primary support bracket angle the interface will still allow for +/− 10-degree rotation between the support bracket and the wall assembly.

Figures 11A, 11B, 11C, 11D, 11E:
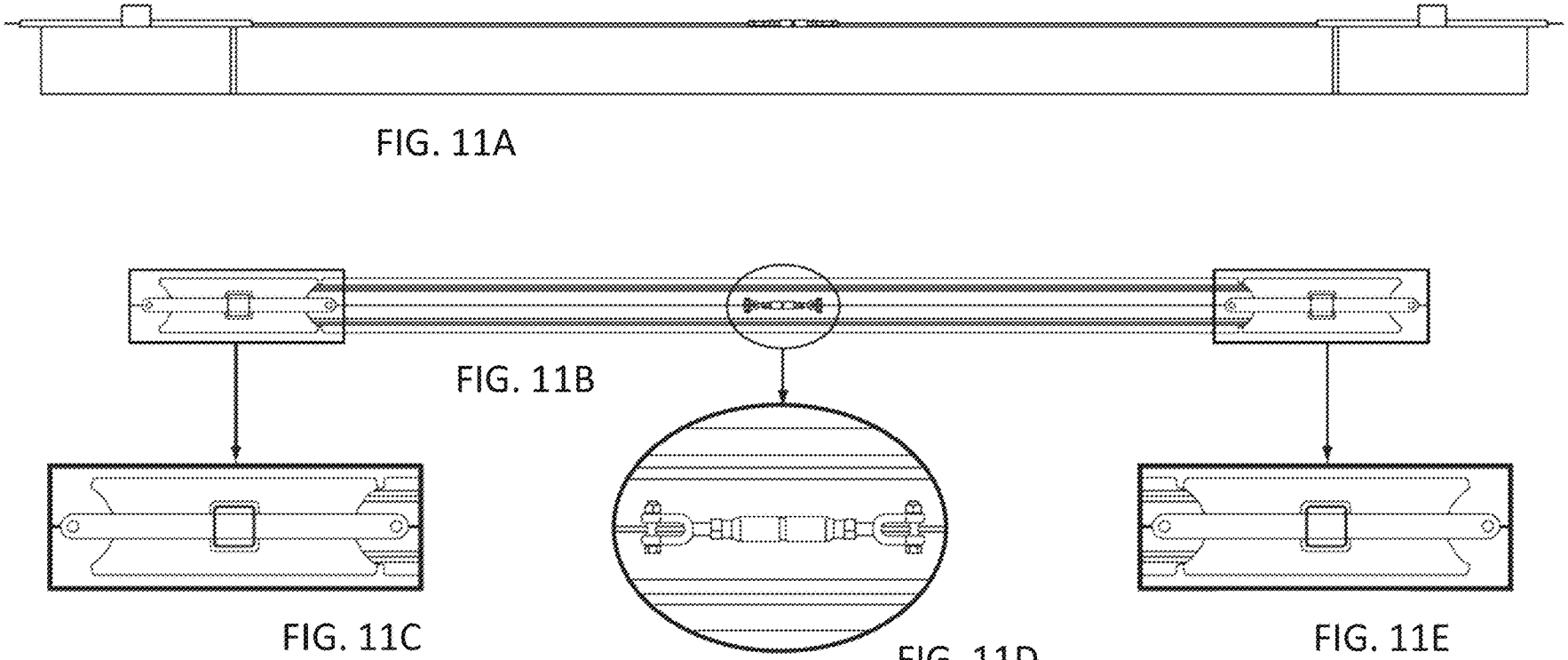
FIG. 11A, FIG. 11B, FIG. 11C, FIG. 11D, and FIG. 11E illustrate details of the tension reinforcement anchor assembly.

FIG. 11A, FIG. 11B, FIG. 11C, FIG. 11D, and FIG. 11E illustrate details of the tension reinforcement anchor assembly with an adjustable tensioner as used in the invention. FIG. 11A shows an elevation view of the complete tensioner assembly between two adjacent upright assemblies with a horizontal cross member in-between and the upright assembly and horizontal cross member top caps removed. The tensioner assembly ensures each horizontal cross member assembly remains seated in-between the two upright assemblies and provides a continuous structural connection along the length of the wall system to resist lateral forces such as wind loads. FIG. 11B illustrates a plan view of the complete tensioner assembly between two adjacent upright assemblies with a horizontal cross member in between and the upright assembly and horizontal cross member top caps removed. FIG. 11C and FIG. 11E illustrate magnified plan views of the two tension reinforcement anchors sleeved into the upright assembly with the top cap removed. FIG. 11D illustrates a magnified plan view of the horizontal cross member with the cable tensioner with the top cap removed. The cable tensioner provides on-site adjustment of the cable tension. Additionally, FIG. 11D shows the recessed track in the top of the horizontal cross member where the tension cable and tensioner reside. Furthermore, the cable tension can be accessed post installation, allowing for adjustment to the horizontal cross member assembly system as required while in service.

Figure 12:
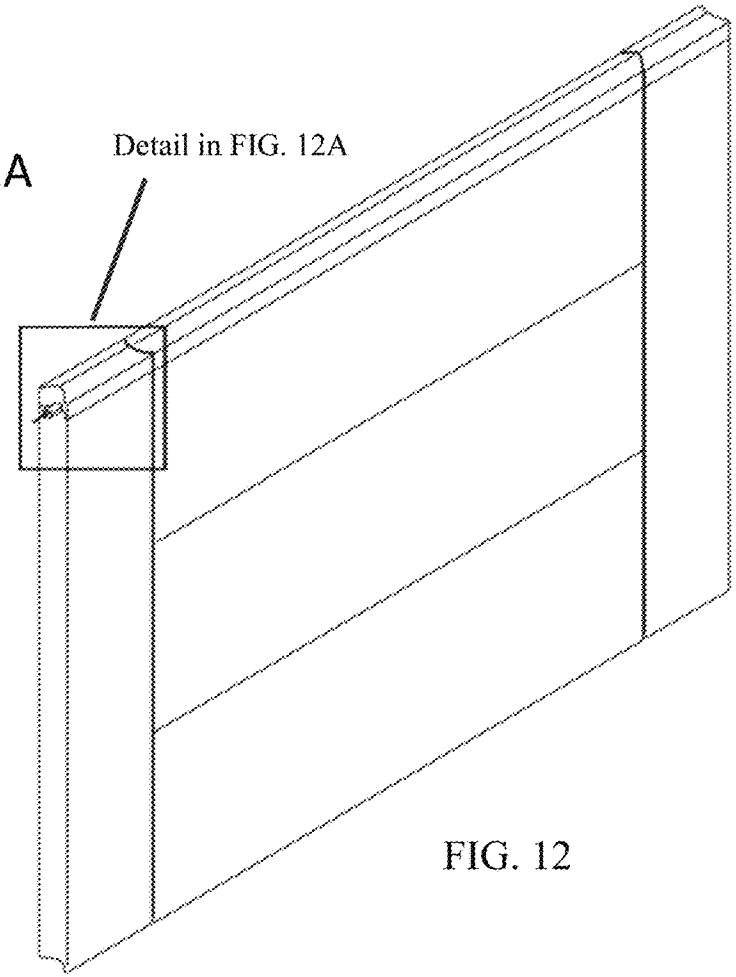
FIG. 12, FIG. 12A and FIG. 12B illustrate magnified views of the tension reinforcement anchor assembly.
Figure 12A:
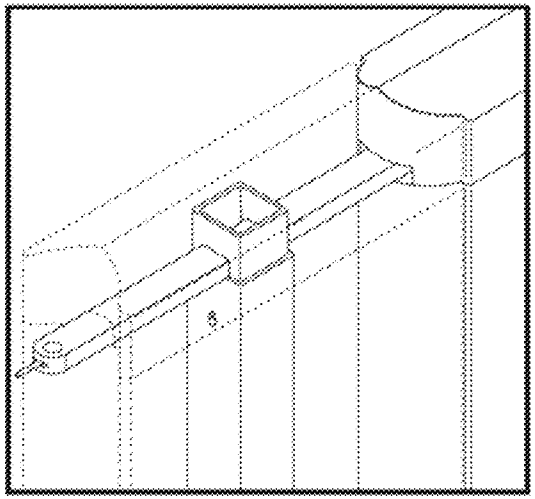
Figure 12B:
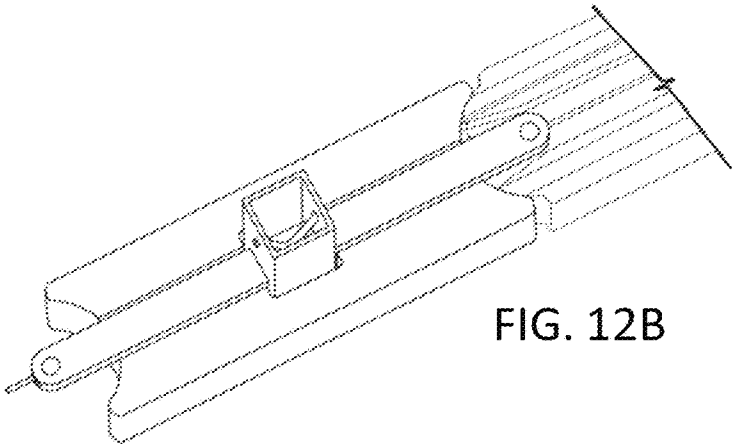

FIG. 12A illustrates a magnified view of the tension reinforcement anchor assembly sleeved into the upright assembly as it interfaces with an adjacent horizontal cross member assembly with the upright assembly member and top cap shown transparently. FIG. 12B illustrates the tension reinforcement anchor set into the recessed track of the bottom of the top cap in an inverted view. The recessed track in the bottom of top cap and the adjacent horizontal cross member top cap is also shown with the end of the track flared, allowing for +/−10-degree rotation between the support bracket and the horizontal cross member assembly.

Figure 13A:
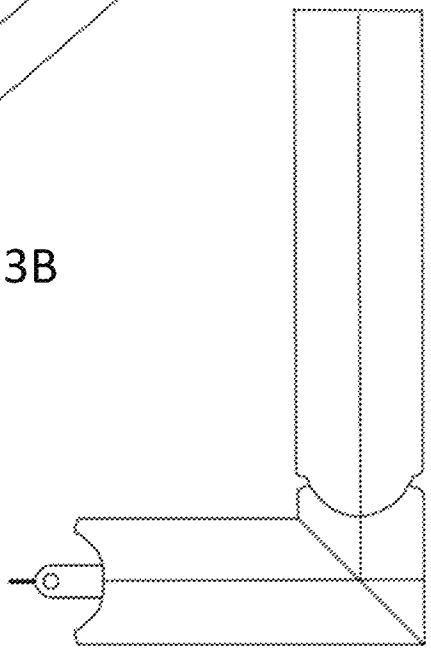
FIG. 13A FIG. 13B and FIG. 13C illustrate the top with various large angle configurations.
Figure 13B:
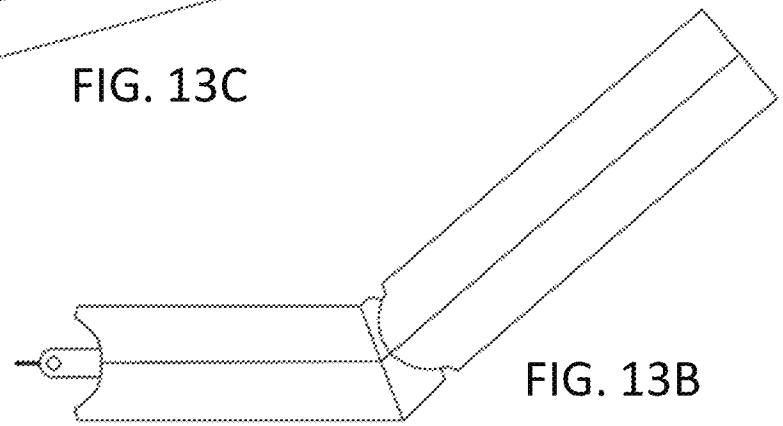
Figure 13C:
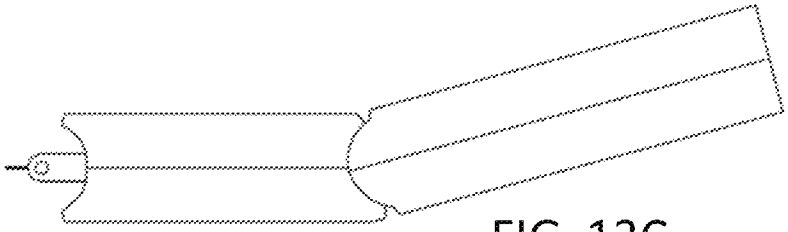

FIG. 13A, FIG. 13B, and FIG. 13C illustrate various large angle upright assembly top cap configurations. FIG. 13C illustrates the 15-degree angle upright assembly top cap. FIG. 13B illustrates the 45-degree angle upright assembly top cap. FIG. 13A illustrates the 90-degree angle upright assembly top cap. These illustrations are provided as examples of alternative angles and should not be considered exclusive to other angles or configurations. Regardless of the primary upright assembly angle the interface will still allow for +/− 10-degree rotation between the support bracket and the horizontal cross member assembly.

Figure 14C:
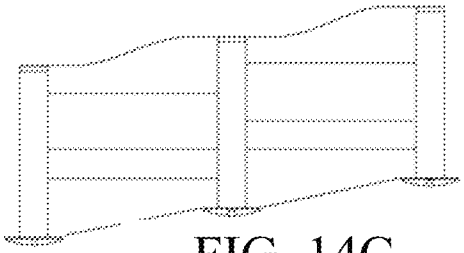
FIG. 14A, FIG. 14B and FIG. 14C illustrate various versions of the constructed wall assembly that may be used depending on terrain conditions.
Figure 14B:
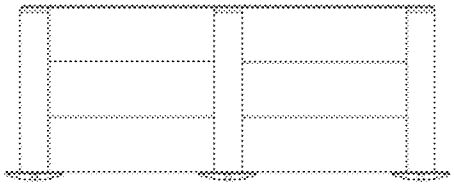
Figure 14A:
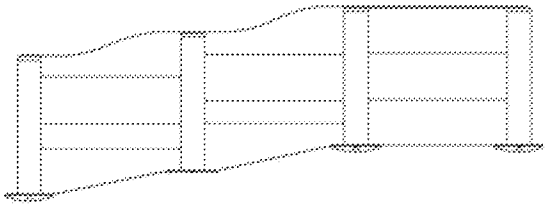

FIG. 14A, FIG. 14B and FIG. 14C illustrate various versions of the constructed horizontal cross member assembly that are be used depending on terrain conditions at the installation location. More specifically, FIG. 14A shows an assembly that is used with sloped and/or hilly terrain. FIG. 14B shows an assembly used with flat terrain. Finally, FIG. 14C shows an assembly used where there a transition from flat to sloped terrain.

Those skilled in the art will also recognize that the objectives of this invention are to substantially reduce material construction cost, reduce shipping, handling, and installation costs. Moreover, its attributes are focused on how the wall itself is constructed e.g., an expanded or extruded polystyrene core coated with a durable shell, how the wall is assembled viz. using multiple interlocking wall panels and its use of an upright member assembly and the type of support bracket/footer. Further the wall assembly has the ability to be adjusted angularly because of the joint connection between the wall panel ends and the main upright member assembly. Further, the foam sound barrier as described herein reduces on-site installation costs and substantially reduces long-term maintenance costs and utilizes 100% recyclable materials.

In the foregoing specification, specific embodiments of the present invention have been described. However, one of ordinary skill in the art appreciates that various modifications and changes can be made without departing from the scope of the present invention as set forth in the claims below.

Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

I claim:

1. A foam highway sound barrier system comprising:

a plurality of foam panels each having an interior core and covered in a mechanically applied exterior material;

at least one upright member assembly comprising an upright body, an upright support member, at least one cable assembly for providing tension reinforcement, and an anchor bar attached substantially orthogonally to an upper end of the upright support member, wherein a plurality of inserted sleeves are each attached to respective ends of the anchor bar for fastening a tensioning cable of the at least one cable assembly, the tensioning cable joining the anchor bar to an adjacent anchor bar of an adjacent upright member assembly, wherein the upright member assembly is fastened to the ground;

at least one rotatable joint formed between the upright member assembly and one of said plurality of foam panels, wherein the foam panel comprises radiused surfaces that extend into corresponding radiused surfaces of the upright body to form a rotatable joint that is moveable in a range from 0 to +/− 10 degrees;

wherein the plurality of foam panels and the at least one upright member assembly are joined to form a wall whose shape is horizontally adjustable through the use of the at least one rotatable joint at the side of each panel, and wherein the plurality of foam panels provide no horizonal load to the at least one upright member assembly enabling greater stability when assembled.

2. A foam highway sound barrier system as in claim 1, wherein the upright body includes a hole through its core to accept the upright support member.

3. A foam highway sound barrier system as in claim 2, wherein the anchor bar is formed as a T-shaped bracket configured to be sleeved into an open channel at the upper end of the upright support member.

4. A foam highway sound barrier system as in claim 1, wherein the interior core of each foam panel is comprised of expanded polystyrene foam with a predetermined density.

5. A foam highway sound barrier system as in claim 1, wherein the interior core of each foam panel is comprised of extruded polystyrene foam.

6. A foam highway sound barrier system as in claim 1, wherein the exterior material of each foam panel is comprised of a polyurea type compound.

7. A foam highway sound barrier system comprising:

at least one upright member assembly comprising an upright body, an upright support member, a T-shaped support bracket, and at least one cable for providing tension reinforcement;

a plurality of foam panels each attached to the at least one upright member assembly and each having an interior core and covered in an exterior material, wherein the T-shaped support bracket includes an anchor bar attached substantially orthogonally to an upper end of the upright support member, wherein a plurality tension reinforcement anchors comprising inserted sleeves, each attached to respective ends of the anchor bar, are used for fastening a tensioning cable of the at least one cable, the tensioning cable joining the anchor bar to an adjacent anchor bar of an adjacent upright member assembly;

wherein the plurality of foam panels and the at least one upright member assembly are joined to form a wall whose shape is adjustable through the use of at least one rotatable joint at the side of each panel such that the at least one rotatable joint is formed between the upright body and one of the plurality of foam panels, wherein the foam panel uses a radiused surface that extends into a corresponding radiused surface of the upright body to form a rotatable joint that is moveable in an infinite range from 0 to +/− 10 degrees, and wherein the plurality of foam panels provide no horizonal load to the at least one upright member assembly enabling greater stability when assembled.

8. A foam highway sound barrier system as in claim 7, wherein the upright body includes a hole through its core to accept the upright support member.

9. A foam highway sound barrier system as in claim 7, wherein the T-shaped support bracket is configured to be sleeved into an open channel at the upper end of the upright support member.

10. A foam highway sound barrier system as in claim 7, wherein the interior core of each foam panel is comprised of expanded polystyrene foam with a predetermined density.

11. A foam highway sound barrier system as in claim 7, wherein the interior core of each foam panel is comprised of extruded polystyrene foam with a predetermined density.

12. A foam highway sound barrier system as in claim 7, wherein the exterior material of each foam panel is comprised of a polyurea type compound.

13. A foam highway sound barrier system comprising:

at least one upright member assembly comprising an upright body haying a hole longitudinally through its core for securing the upright body to an upright support member fastened within the ground, and at least one tension reinforcement anchor assembly for providing horizontal tension reinforcement, wherein the upright member assembly includes an anchor bar attached substantially orthogonally to an upper end of the upright support member, wherein a plurality of inserted sleeves are each attached to respective ends of the anchor bar for fastening a tensioning cable joining the anchor bar to an adjacent anchor bar of an adjacent upright member assembly;

a plurality of foam panels each attached to the at least one upright member assembly and each having an interior core and covered in an exterior material;

a tensioner attached to ends of the tensioning cable for adjusting cable tension when adjacent upright member assemblies are joined by the cable; and wherein the plurality of foam panels and the at least one upright member assembly are joined to form a wall whose shape is adjustable though the use of at least one rotatable joint movable in a range from 0 to +/− 10 degrees at the side of each panel such that the at least one rotatable joint is formed between the at least one upright member assembly and one of the plurality of foam panels, wherein the foam panel uses a radiused surface that extends into a corresponding radiused surface of the upright body, and wherein the plurality of foam panels provide no horizonal load to the at least one upright member assembly enabling greater stability when assembled.

14. A foam highway sound barrier system as in claim 13, wherein the anchor bar is formed as a T-shaped bracket configured to be sleeved into an open channel at the upper end of the upright support member.

15. A foam highway sound barrier system as in claim 13, wherein the interior core of each foam panel is comprised of expanded polystyrene foam with a predetermined density.

16. A foam highway sound barrier system as in claim 13, wherein the interior core of each foam panel is comprised of extruded polystyrene foam with a predetermined density.

* * * * *